US005586358A

United States Patent [19]

Wolfe et al.

[11] Patent Number: 5,586,358

[45] Date of Patent: Dec. 24, 1996

[54] HAND CARRIABLE VACUUM CLEANER WITH ACCESSORY ATTACHMENT

[75] Inventors: Jack Wolfe, Discovery Bay; Roy C. C. Ping, North Point, both of Hong Kong

[73] Assignees: Bissell; by said Jack Wolfe; TTI; by said Roy Chung Chi Ping

[21] Appl. No.: 290,429

[22] Filed: Aug. 15, 1994

[51] Int. Cl.[6] ..... A47L 5/32

[52] U.S. Cl. ..... 15/334; 15/337; 15/338; 15/344; 15/410

[58] Field of Search ..... 15/344, 338, 337, 15/334, 331, 410

[56] References Cited

U.S. PATENT DOCUMENTS

| | | | |
|---|---|---|---|
| 1,302,929 | 5/1919 | Kirby | 15/334 |
| 2,219,810 | 2/1938 | Foss . | |
| 2,639,456 | 5/1953 | Smith | 15/410 X |
| 2,806,242 | 9/1957 | Sparklin | 15/334 X |
| 3,300,806 | 1/1967 | Ripple | 15/334 |
| 4,642,841 | 2/1987 | Berfield et al. . | |
| 4,660,246 | 4/1987 | Duucan et al. . | |
| 4,685,171 | 8/1987 | Beaudoin . | |
| 4,850,076 | 7/1989 | Ostroski et al. | 15/328 |
| 4,947,512 | 8/1990 | Lackner et al. | 15/410 X |
| 4,993,108 | 2/1991 | Genge et al. . | |
| 5,086,536 | 2/1992 | Lackner et al. | 15/328 |
| 5,129,128 | 7/1992 | Bowerman et al. | 15/413 |
| 5,329,666 | 7/1994 | Bowerman et al. | 15/323 |
| 5,331,716 | 7/1994 | Hemmann et al. | 15/332 |
| 5,355,549 | 10/1994 | Steinberg et al. | 15/334 |

FOREIGN PATENT DOCUMENTS

| | | | |
|---|---|---|---|
| 1208457 | 1/1966 | Germany | 15/334 |

*Primary Examiner*—Chris K. Moore
*Attorney, Agent, or Firm*—Brooks & Kushman P.C.

[57] ABSTRACT

A hand held vacuum cleaner portable by a user during use is disclosed. The vacuum cleaner has a housing defining a main inlet, an accessory inlet, an exhaust outlet, and a vacuum passageway interconnecting the inlets to the outlet. An impeller is driven by a motor to create a stream of air passing downstream selectively from the main inlet or from the accessory inlet to the exhaust outlet. A cover is sealingly and selectively mountable over the main inlet and the accessory inlet for selecting a stream of air passing downstream from one of the main inlet or the accessory inlet. Also, the vacuum cleaner may have a pair of clip assemblies and a strap. The clip assemblies are ideally selectively positionable between a retracted position flush with the contours of the main housing of the vacuum cleaner and an extended position wherein the strap may be attached to the clip assemblies. Also, the vacuum cleaner may have a power cord pivotally attached and selectively positionable relative to the housing to provide strain relief to the cord.

11 Claims, 4 Drawing Sheets

Fig. 5
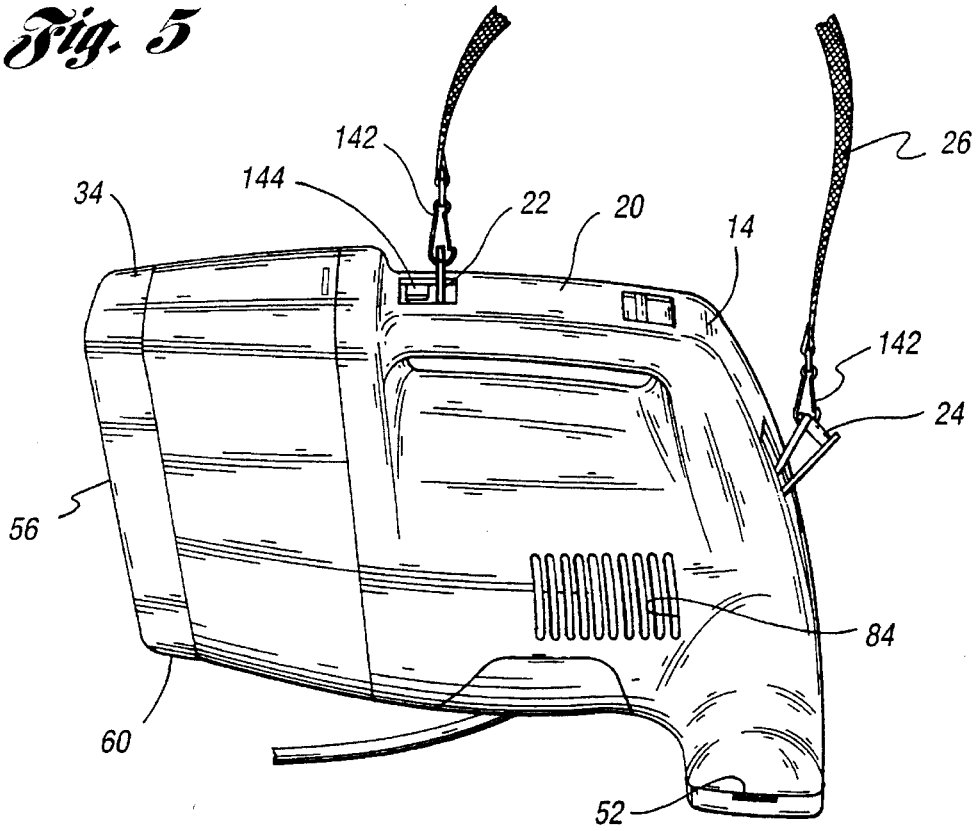
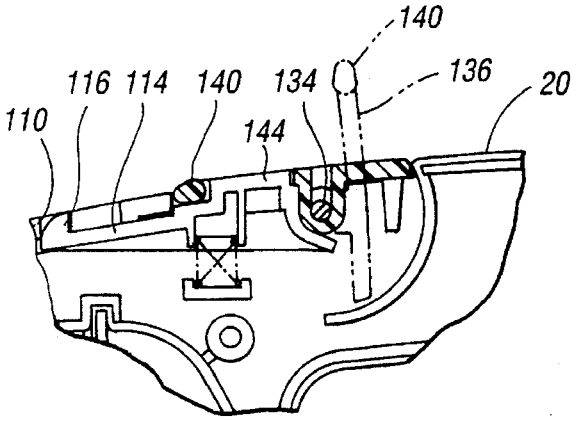
Fig. 6
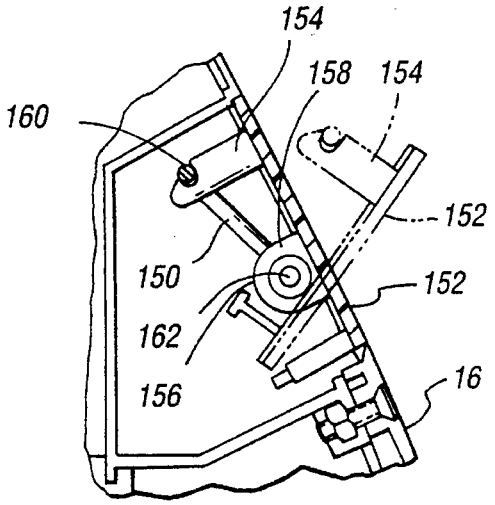
Fig. 7

HAND CARRIABLE VACUUM CLEANER WITH ACCESSORY ATTACHMENT

TECHNICAL FIELD

This invention relates to convertible vacuum cleaners which can be used to clean floors, or alternatively, can be converted to receive accessories for off-floor cleaning.

BACKGROUND ART

Conventional convertible vacuum cleaners can be converted between floor and off-floor cleaning modes. In the floor mode, brush or beater mechanisms are often used to dislodge dirt from a floor or carpet. In the off-floor mode, accessory attachments including hoses are used to clean items such as hanging curtains or upholstery.

These conventional convertible vacuum cleaners are quite different from portable or hand carriable vacuum cleaners. First, as the conventional vacuum cleaners are designed to roll upon and vacuum a floor or carpet, they are generally quite heavy. Wheels are employed beneath the base of these vacuum cleaners to assist in moving the vacuum cleaner across the floor. Second, in vacuum cleaners having off-floor cleaning accessory attachments, the vacuum cleaners often have complicated lever or cam operated control mechanisms for controlling the pathway of a stream of air through the vacuum cleaner. These control mechanisms selectively connect the vacuum stream of air created by a fan or impeller to either a base for floor cleaning, or else, to an accessory attachment for off-floor cleaning.

There exists a need for a portable vacuum cleaner which enjoys the advantages of conventional convertible vacuum cleaners while overcoming many of their drawbacks. First, the portable vacuum cleaner should be lightweight to facilitate easy carrying of the vacuum cleaner during use. Second, the control mechanism for controlling the communication of the vacuum stream of air through either a beater brush mechanism or else an accessory vacuum hose, should be simple and inexpensive to manufacture. Third, the control mechanism should be damage resistant and reliable.

Further, it is desirable to provide a vacuum cleaner which allows a user to carry the vacuum cleaner during use with both of the user's hands being free of the main body of the vacuum cleaner. This allows a user to use the vacuum cleaner while in awkward positions such as when standing on a ladder.

The present invention is intended to meet the above identified needs.

DISCLOSURE OF INVENTION

An object of the present invention is to provide a vacuum cleaner which is portable during use and has both a beater brush mechanism and an accessory attachment for off-floor cleaning.

It is a further object to provide a vacuum cleaner with a simple, inexpensive mechanism for selectively placing a vacuum cleaner in either a main operating mode or in an accessory operating mode.

It is yet a further object to provide a closure cover which alternatively seals across an inlet for a brush mechanism and an inlet for receiving an accessory attachment.

Still another object is to provide a hand carriable vacuum cleaner having a strap and accessory attachments, such as a hose, wherein the vacuum cleaner can be supported by the strap about a user's head and shoulders with the user's hands being free to control the accessory attachments.

Yet another object is provide a detachable strap which attaches to a portable vacuum cleaner, the strap releasably attaching to clip mechanisms which fold away into flush, non-snagable positions when not being used.

Still another object is to provide a vacuum cleaner having a power cord pivotally attached and selectively positionable relative to a housing to provide strain relief to a power cord.

In carrying out the above objects, a hand held vacuum cleaner portable by a user during use is disclosed. The vacuum cleaner has a housing defining a main inlet, an accessory inlet, an exhaust outlet, and a vacuum passageway interconnecting the inlets to the outlet. A motor is supported by the housing. Preferably, a beater brush is driven by the motor and is located in the main inlet to brush a work surface during the use of the vacuum cleaner. An impeller is located in the vacuum passageway intermediate the main and accessory inlets and the exhaust outlet. The impeller is driven by the motor to create a stream of air passing downstream selectively from the main inlet or from the accessory inlet to the exhaust outlet. A cover is sealingly and selectively mountable over the main inlet and over the accessory inlet for selecting the pathway a stream of air takes in passing downstream from one of the main inlet or the accessory inlet.

Also, the vacuum cleaner may have a pair of clip assemblies and a strap. The clip assemblies are ideally selectively positionable between a retracted position flush with the main housing of the vacuum cleaner and an extended position wherein the strap may be attached to the clip assemblies. Also, the vacuum cleaner may have a power cord pivotally attached and selectively positionable relative to the housing to provide strain relief to the cord.

BRIEF DESCRIPTION OF THE DRAWINGS

These and other features, objects, and advantages of the present invention will become readily apparent from the following description, pending claims, and accompanying sheets of drawings where:

FIG. 5 is a perspective view of the vacuum cleaner including a carrying strap;

FIG. 6 is an enlarged fragmentary sectional view of a first clip assembly in a retracted, flush position in full line, and, in phantom, an extended position;

FIG. 7 is an enlarged fragmentary sectional view of a second clip assembly in a retracted, hidden position in full line, and in phantom, in an extended position;

BEST MODE FOR CARRYING OUT THE INVENTION

Figure 1:
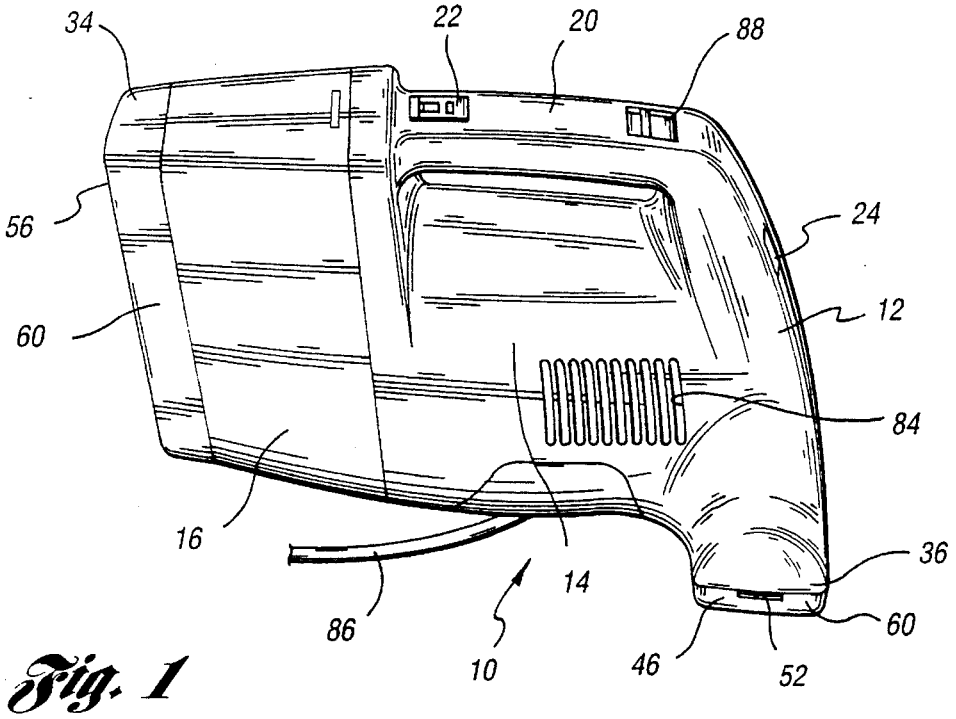
FIG. 1 is a perspective view of a vacuum cleaner, made in accordance with the present invention, operable in a main mode to vacuum debris into a main inlet at the front of the vacuum cleaner.
Figure 2:
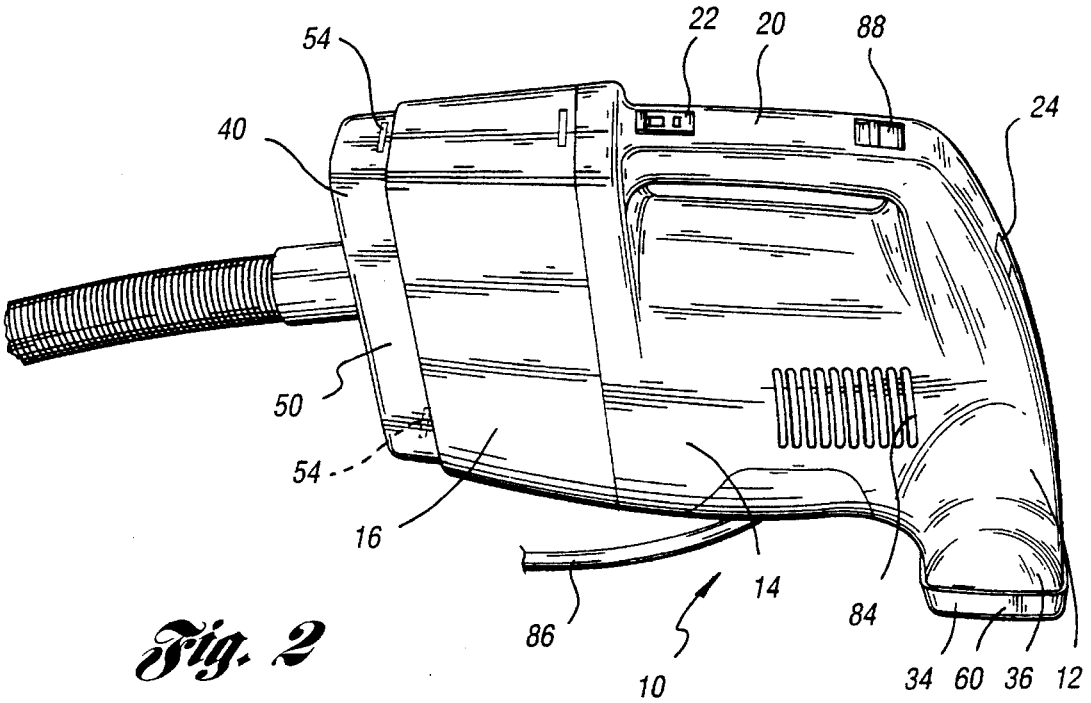
FIG. 2 is a perspective view of the vacuum cleaner operable in an accessory mode to vacuum debris into an accessory inlet at the rear of the vacuum cleaner.

FIGS. 1 and 2 show a portable vacuum cleaner 10 made in accordance with the present invention. In FIG. 1, portable vacuum cleaner 10 is operable in a main mode, to beat and clean dirt or debris from a carpet or upholstery. Alternatively, in FIG. 2, vacuum cleaner 10 is shown in an accessory mode wherein hanging articles, such as curtains, or else hard to reach areas which are inaccessible using a conventional portable vacuum cleaner, can be cleaned using accessory attachments.

Vacuum cleaner 10 includes a main housing 12 comprising a forward housing 14 and a dirt cup 16. Dirt cup 16 is removably attached to forward housing 14 as will be described later and is used to store dust and debris. A handle 20 is formed in forward housing 14 to allow vacuum cleaner 10 to be easily gripped.

Clip assemblies 22 and 24 are retained within forward housing 14. A strap 26, as shown in FIG. 5, may be releasably attached to clip assemblies 22 and 24. Strap 26 may then be draped about a user's head and shoulders to transport vacuum cleaner 10 without having grasp handle 20. This feature is advantageous when a user's hands are otherwise occupied. For example, one hand may be used to grab a rung of a ladder and the other to hold and guide an accessory for cleaning such as a hose and attached end piece.

Figure 3:
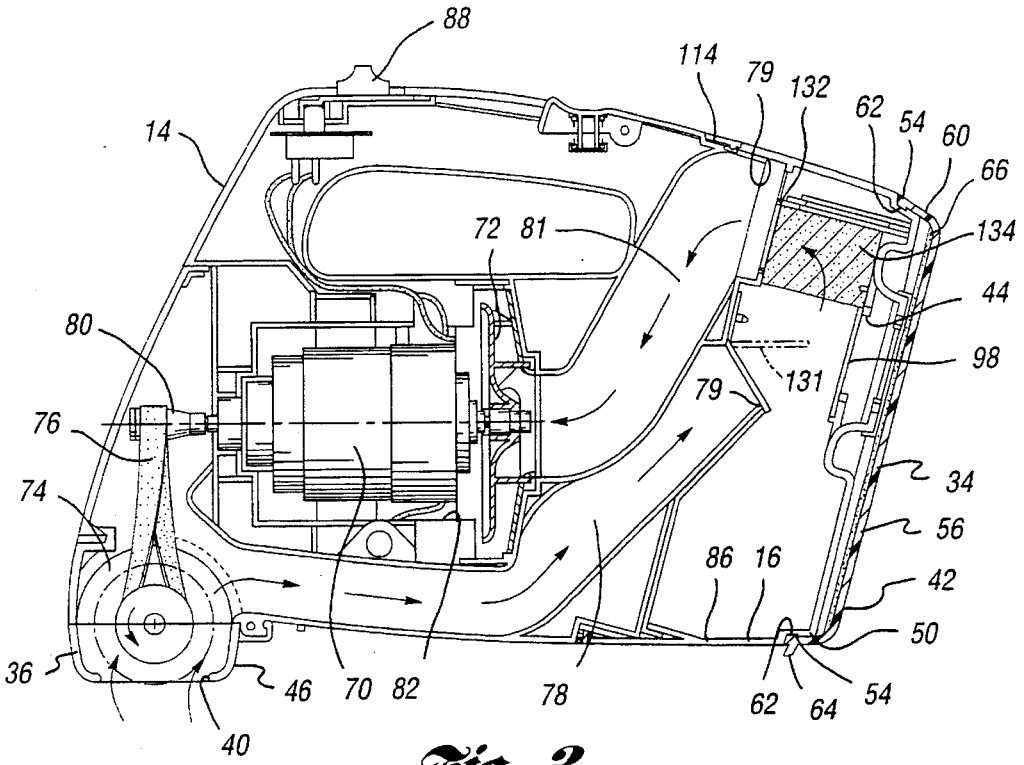
FIG. 3 is a sectional view of the vacuum cleaner operating in a main mode with a cover covering the accessory inlet.
Figure 4:
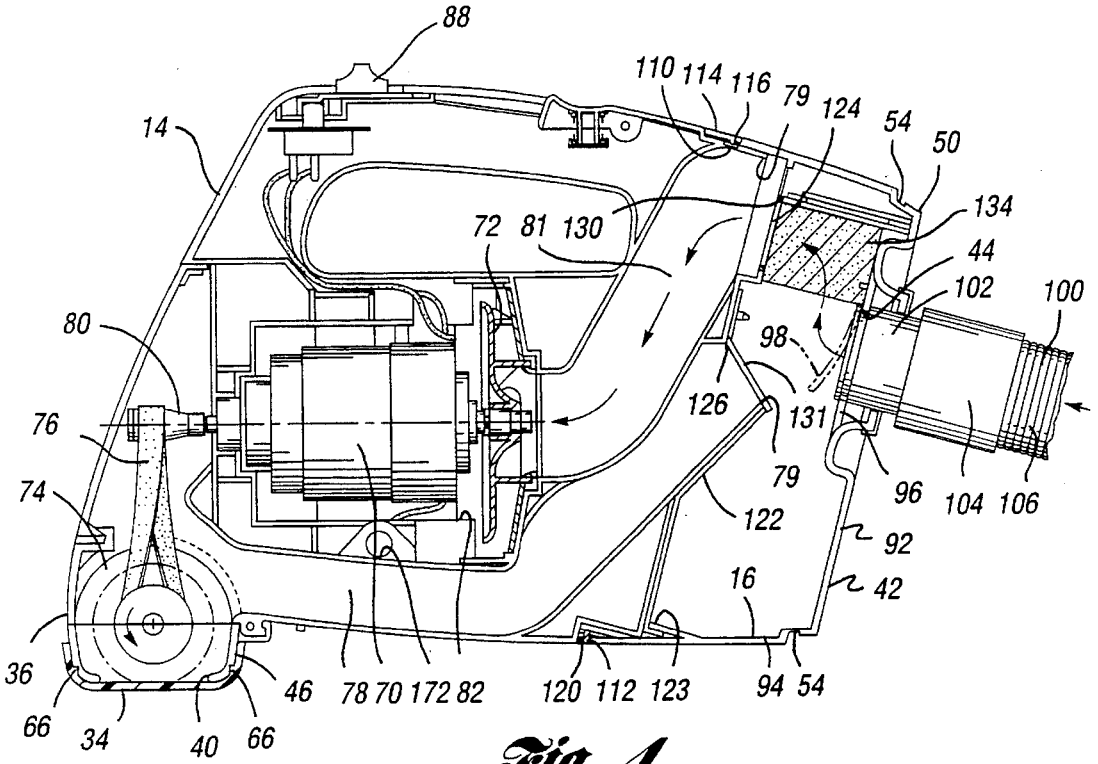
FIG. 4 is a sectional view of the vacuum cleaner operating in the accessory mode with a cover covering the main inlet.

A cup-shaped closure cover 34 is selectively mounted to forward housing 14 or to dirt cup 16 to convert vacuum cleaner 10 between operation in the accessory mode and the main mode. A forward portion 36 of forward housing 14 has a rectangular-shaped main inlet 40 defined therein, as best seen in FIGS. 3 and 4. A rear portion 42 of dirt cup 16 has a circular-shaped accessory inlet 44. Forward portion 36 and rear portion 42 have identically shaped outer peripheries 46 and 50 configured to have cover 34 snugly mounted thereover. Outer peripheries 46 and 50 each have a respective pair of spaced apart retaining recesses 52 and 54 formed therein, as seen in FIGS. 1 and 2.

Figure 9:
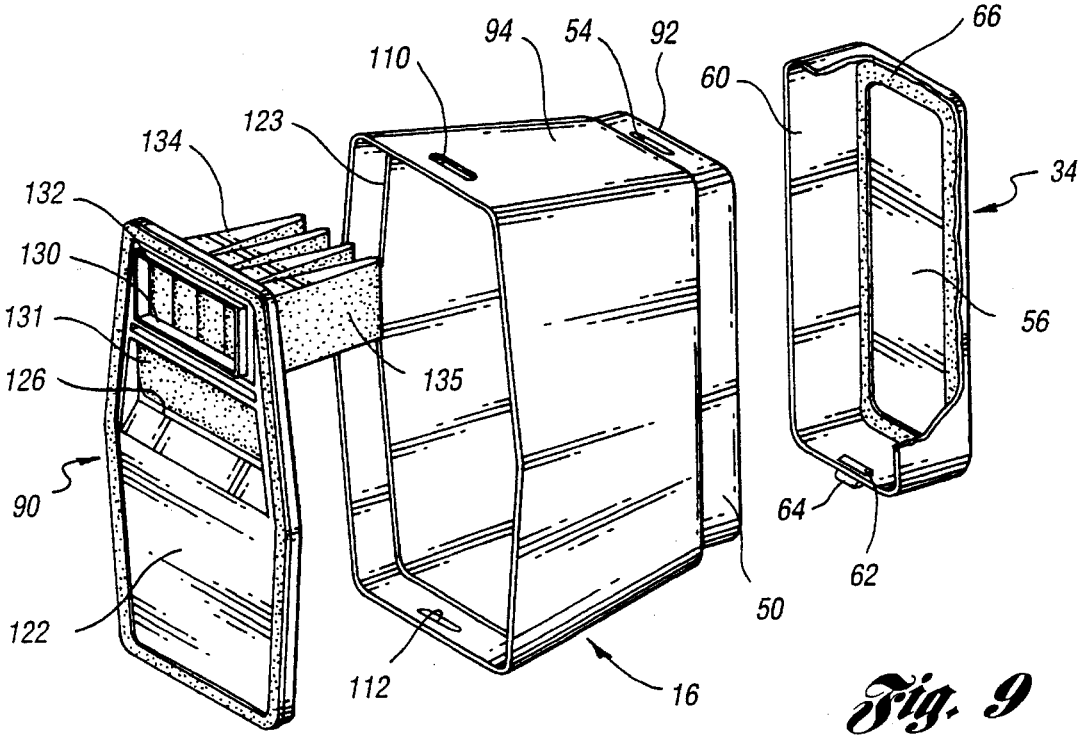
FIG. 9 is an exploded perspective view, partially in cutaway, of a filter assembly which is retained in a dirt cup and a cover which fits over the dirt cup.

Referring to FIGS. 3, 4 and 9, cover 34 includes a base portion 56 and a surrounding peripheral wall portion 60. Formed on the inside of wall portion 54 are a pair of spaced apart retaining tabs 62 which are sized to cooperate with respective retaining recesses 52 and 54. A release tab 64 is located adjacent one of the retaining tabs 62 on the exterior of wall portion 54 to help pry cover 34 and retaining tabs 62 free of either recesses 52 or 54.

A peripheral rectangular elastomeric seal 66 is attached on the inner perimeter of base portion 56 adjacent wall portion 60. Elastomeric seal 66 compresses against respective forward portion 36 of front housing 14 or rear portion 40 of dirt cup 16 to effect a seal between cover 34 and main housing 12. The selective mounting of cover 34 over either forward portion 36 or rear portion 42 effectively prevents air from passing through respective main inlet 40 or accessory inlet 44 so that air must pass through the remaining uncovered inlet 40 or 44.

FIGS. 3 and 4 display sectional views of vacuum cleaner 10 illustrating internal components and the alternative pathways a vacuum stream of air follows in the main mode and in the accessory mode. Located within main housing 12 is a motor 70. Motor 70 drives a both an impeller 72 and a brush assembly 74 which are rotatably mounted in forward housing 14. An elastomeric band 76 extends between a motor spindle 80 connected to motor 70 and brush assembly 74 to provide a drive means. Motor 70 is located within a motor cavity 82. Exhaust vents 84, as seen in FIGS. 1 and 2, are disposed in forward housing 14. An electrical or power cord 86 delivers power to motor 70. A switch 88 is utilized to turn motor 70 on and off.

A lower passageway 78 extends from brush inlet 40 to a rear opening 79 in forward housing 14. An upper passageway 81 extends from the rear of forward housing 14 to motor cavity 82. Impeller 72 is located in motor cavity 82.

Dirt cup 16 has a rear wall 92 connected to a peripheral wall 94. Accessory inlet 44 is formed in rear wall 92 by an annular ring 96. A hose 100, as seen in FIG. 4, has a reduced diameter sleeve 102 attached to a larger diameter collar 104 which, in turn, is connected to a flexible hose portion 106. Although not shown, many standard vacuum end pieces can be attached to the end of hose 100 to accomplish desired vacuuming operations.

Sleeve 102 is sized to be received within accessory inlet 44 of annular ring 96 in a releasably press-fit manner. Further, sleeve 102 and annular ring 96 may be designed to include a bayonet-type connection therebetween. Collar 104 abuts rear wall 92 to locate sleeve 102. A flap 98 is hingedly suspended over the inner side of accessory inlet 44 to prevent dirt from escaping therethrough when dirt cup 16 is removed from forward housing 14.

Located at the forward ends of rear wall 92 of dirt cup 16 are respective top and bottom retaining apertures 110 and 112. Similarly, located at the top rear of forward housing 14 is a cantilevered lever 114 having a spring biased upwardly extending retaining prong 116 at its free end. See FIG. 6. Permanently affixed at the lower rear of forward housing 14 is downwardly extending prong 120. Dirt cup 16 can be forced over the rear of forward housing 14 with lever 114 being depressed by dirt cup 16 and retaining apertures 110 and 112 receiving prongs 116 and 120. Lever 114 can be depressed to disengage prong 116 from retaining aperture 110 which then allows lower prong 120 to be removed from aperture 112.

Filter assembly 90, as best seen in FIG. 9, includes a bulkhead 122 and a filter element 134. Bulkhead 122 seats against a peripherally stepped recess 123 formed on the inner periphery of peripheral wall 94. Bulkhead 122 has a flap opening 126 and a filter opening 130. Flap opening 126 has a flap 131 suspended thereacross which can swing open into dirt cup 16 but is prevented from swinging forwardly into lower passageway 78 by striking bulkhead 122.

Filter assembly 90 includes a rectangular frame 132 which supports a filter element 134. Filter element 134 has a plurality of convolutions 135 formed therein to provide a large filter surface area. Rectangular frame 132 interfits with filter opening 130 to position filter element 134 within dirt cup 16. When dirt cup 16 is snapped into engagement with forward housing 14, bulkhead 122 of filter assembly 90 is captured between forward housing 14 and dirt cup 16.

In the main operating mode, cover 34 is secured to rear portion 42 of dirt cup 16 sealing off accessory inlet 44. When motor 70 is activated, impeller 72 is driven to create a vacuum stream of air which follows the pathway of arrows shown in FIG. 3. The stream of air follows the passageway from brush inlet 40 through lower passageway 78 and out opening 79 and into dirt cup 16 through flap opening 126. Debris is removed from the stream of air as the air passes through filter element 134 with the debris collected in dirt cup 16. The cleaned air then passes through upper passageway 81, past impeller 72 and out of motor cavity 82 through exhaust vents 84.

To convert vacuum cleaner 10 from the main mode to the accessory mode, release tab 64 on cover 34 is pulled upon disengaging retaining tab 62 from the lower retaining recess 54. This allows upper retaining tab 62 to be removed from upper retaining recess 54. Cover 34 is then forced over front portion 36 of forward housing 14 with retaining tabs 62 snapping into laterally spaced retaining recesses 54 sealing off main inlet 40. Next sleeve 102 of hose 100 is installed into accessory inlet 44. This causes flap 98 to swing open.

The pathway for the vacuum stream of air is then as shown in FIG. 4. The stream of air enters hose 100 and passes into dirt cup 16 where the air is stripped of dirt and debris by filter element 134. The air passes through filter opening 130, upper passageway 81 into motor cavity 82 and out exhaust vents 84.

FIGS. 6 and 7 illustrate respective clip assemblies 22 and 24. Clip assembly 22 includes a pivot pin 134 located in a recess in handle 20 on to which a T-shaped member 136 is attached. One end of member 136 has a transversely extending cross-bar 140 for receiving a clip 142 on strap 26. Clip assembly 22 can be placed in a retracted flush condition with respect to handle 20 as shown in full line in FIG. 6. Alternatively, clip assembly 22 can be pivoted up, as shown in phantom, so that clip 142 can attach to cross-bar 140. Member 136 has an aperture through which projects a button 144 which is integral with lever 114. Button 144 can be depressed when member 136 is its retracted position condition or when member 136 is pivoted upwardly to allow prong 116 to disengage retaining aperture 110 in dirt cup 16.

Accordingly, clip assembly 22 is of an undisruptive styling since it is integrated to work with lever 114 which releases dirt cup 16. Clip assembly 22 does not raise above the surface contour of forward housing except in use.

Clip assembly 24, as best seen FIG. 7, has a wire member 150 attached to forward housing 14 on to which a cover member 152 is mounted. Cover member 152 has a depending stem 154 which supports wire member 150 and has a pair of hubs 156 pivotally mounted on a pair of laterally spaced apart annular projections 158 of forward housing 14. Wire member 150 is U-shaped having a bight portion 160 which serves as a cross-bar to which a clip 142 of strap 26 can be attached. A pair of end portions 162 on wire member 150 extend outboard into apertures formed in projections 158.

Cover member 152 is selectively positionable between a retracted flush condition smooth with the contour of forward housing 14 wherein bight portion 160 is hidden and an operative extended position, as shown in phantom, wherein a clip 142 of strap 126 may be attached to bight portion 160. Bight portion 160 is accessed by depressing the lower area of cover member 152 to pivot bight portion 160 and cover member 152 away from forward housing 16.

With clip assemblies 22 and 24 in their retracted flush conditions, the appearance of vacuum cleaner 10 is sleek and clip assemblies 22 and 24 are unlikely to snag clothing or the like.

Figure 8:
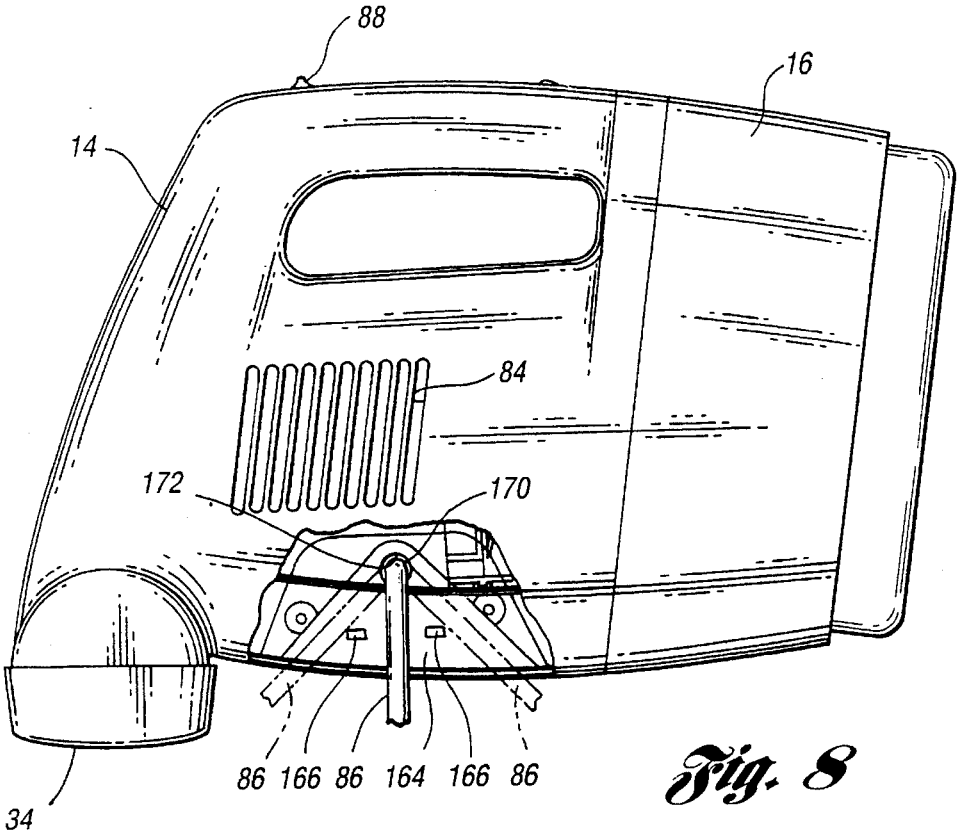
FIG. 8 is a side view, partially in cutaway, showing a swivelably mounted power cord in a plurality of positions with respect to the main vacuum housing.

Looking now to FIG. 8, another feature of the present invention is shown. Power cord 86 is pivotally attached to forward housing 14 in an arcuate channel 164 formed in forward housing 14 to provide strain/bend relief to power cord 86. Detents 166 and 168 are located in channel 164 and are designed to selectively hold cord 30 in front, down or back positions. Channel 164 and detents 166 and 168 are sized so that cord 30 can be squeezed past detents 166 and 168 in channel 164 into the front, down, and back positions. A collar 170 is integrally formed with cord 86, as seen in FIG. 8. Collar 170 is rotatably held within a bore 172 formed in housing 12. Accordingly, cord 30 and collar 170 can be easily rotated relative to housing 12 without inducing stress or strain in cord 30.

While in the foregoing specification of this invention has been described in relation to certain preferred embodiments thereof, and many details have been set forth for the purpose of illustration, it will be apparent to those skilled in the art that the invention is susceptible to alteration and that certain other details described herein can vary considerably without departing from the basic principles of the invention.

What is claimed is:

1. A hand held vacuum cleaner carriable by a user during use, the vacuum cleaner comprising:

a housing defining a main inlet, an accessory inlet, an exhaust outlet, and a vacuum passageway interconnecting the inlets to the outlet;

a motor supported by the housing;

an impeller located in the vacuum passageway intermediate the main and accessory inlets and the exhaust outlet, the impeller driven by the motor to create a stream of air passing downstream selectively from the main inlet or from the accessory inlet to the exhaust outlet;

a cover sealingly and selectively mountable over either the main inlet or the accessory inlet for selecting a stream of air passing downstream from one of the main inlet or the accessory inlet; and a hose removably mountable to the accessory inlet.

2. The vacuum cleaner of claim 1 further comprising:

a beater brush driven by the motor and located in the main inlet to brush a work surface during the use of the vacuum cleaner.

3. The vacuum cleaner of claim 1 wherein:

the cover is cup-shaped having a base portion and a wall portion extending from the base portion.

4. The vacuum cleaner of claim 3 wherein:

the cover further includes an elastomeric seal which is cooperatively squeezed between the cover and the housing to effect a seal preventing air from passing between the cover and the housing during vacuum cleaner use.

5. The vacuum cleaner of claim 3 wherein:

the cover and the housing include a flexible tab and a recess which cooperate with one another to releasably and selectively retain the cover to the housing over the main inlet or over the accessory inlet.

6. A method for selectively converting a hand carriable vacuum cleaner between a main mode and an accessory mode, the method comprising:

removing a cover from sealing one of either a main inlet or an accessory inlet formed in a housing of the hand carriable vacuum cleaner, the main inlet and the accessory inlet each connected by a vacuum passageway in the housing to an exhaust outlet;

mounting the removed cover over the other of the main inlet or the accessory inlet to prevent a stream of air from passing therethrough; and mounting an accessory hose to one of the main or accessory inlets.

7. A hand held vacuum cleaner carriable by a user during use, the vacuum cleaner comprising:

a housing defining a first main inlet, an accessory inlet, at least one exhaust outlet, and at least one vacuum passageway interconnecting the main inlet to the at least one exhaust outlet and interconnecting the accessory inlet to the at least one exhaust outlet;

a motor mounted within the housing;

an impeller mounted within the at least one vacuum passageway and driven by the motor to create a vacuum within the vacuum passageway causing air to be drawn into at least one of the main inlet and the acessory inlet;

a mechanism for selectively interrupting the flow of air in the at least one vacuum passageway whereby air is drawn into one of the inlets and not the other of the inlets, the mechanism including a cover which selectively cooperates with one of the inlets to prevent air from entering therein while allowing air to enter the other of the inlets; and a hose releasably attaching to the accessory inlet.

8. The vacuum cleaner of claim 7 wherein:

the cover is selectively mountable over the main inlet and is selectively mountable over the accessory inlet.

9. The vacuum cleaner of claim 7 further comprising:

a strap which attaches relative to the housing to allow the vacuum cleaner to be carried on a user's shoulder using the strap.

10. The vacuum cleaner of claim 7 wherein:

the housing has a front portion and a rear portion, the front portion rotatably supporting a beater brush therein which extends at least partially through the main inlet.

11. The vacuum cleaner of claim 10 wherein:

the accessory inlet is formed in the rear portion of the housing.

* * * * *